United States Patent [19]

Judge et al.

[11] Patent Number: 4,682,444

[45] Date of Patent: Jul. 28, 1987

[54] MICROFINISHING APPARATUS AND METHOD

[75] Inventors: Norman R. Judge, Dewitt; Edward E. Judge, Jr.; Arthur G. Reiser, both of Lansing, all of Mich.

[73] Assignee: Industrial Metal Products Corporation, Lansing, Mich.

[21] Appl. No.: 785,498

[22] Filed: Oct. 8, 1985

Related U.S. Application Data

[63] Continuation-in-part of Ser. No. 608,201, May 7, 1984, abandoned.

[51] Int. Cl.[4] ..... B24B 1/00; B24B 29/04

[52] U.S. Cl. ..... 51/154; 51/141; 51/289 R; 51/328; 51/394

[58] Field of Search ..... 51/62, 151, 154, 161, 51/145 R, 204, 289 R, 328, 394, 399, 401, 407, 141

[56] References Cited

U.S. PATENT DOCUMENTS

| | | | |
|---|---|---|---|
| 1,905,821 | 4/1933 | Dunbar et al. | 51/154 X |
| 1,908,048 | 5/1933 | Player et al. | 51/154 X |
| 2,270,522 | 1/1942 | Haeger et al. | 51/154 |
| 2,717,422 | 9/1955 | Rowe et al. | 51/141 X |
| 3,021,648 | 2/1962 | Sloan | 51/154 |
| 3,041,792 | 7/1962 | LaFleur | 51/154 |
| 3,835,598 | 9/1974 | Tobey | 51/204 X |
| 4,187,082 | 2/1980 | Guerra | 51/407 X |
| 4,215,516 | 8/1980 | Huschle et al. | 51/399 |

FOREIGN PATENT DOCUMENTS

| | | | |
|---|---|---|---|
| 134757 | 3/1952 | Sweden | 51/141 |
| 1575972 | 10/1980 | United Kingdom | 51/394 |

OTHER PUBLICATIONS

Oldsmobile Drawing Number 47382 JF, Sheet 30, dated 11/17/55.

Oldsmobile Drawing Number 47381 MF, Sheet 11, dated 11/01/55.

Oldsmobile Drawing Number 83559 MF, Sheet 5, dated 04/04/1972.

Oldsmobile Drawing Number 83559 MF, Sheet 12, (date unknown).

Oldsmobile Drawing Number 83559 MF, Sheet 10, dated 04/06/72.

*Primary Examiner*—Robert P. Olszewski

*Attorney, Agent, or Firm*—Harness, Dickey & Pierce

[57] ABSTRACT

A microfinishing apparatus and method is disclosed particularly useful for microfinishing workpiece surfaces such as are found in journal bearings and cylinder bores. This invention improves over conventional machines and methods wherein coated abrasive tape is brought into contact with a relatively rotating workpiece surface and is pressed against that surface by an elastomeric plastic insert. According to this invention, the insert is made from a relatively rigid substance such as honing material stone. Since the insert is made from a rigid material, the insert surface shape is generated in the workpiece surface and therefore geometry corrections in the workpiece surface can be accomplished. In alternate embodiments of this invention, the rigid inserts have relieved portions or noncylindrical surfaces such that a desired surface profile in the workpiece surface is generated. In another embodiment, one or more flexible inserts are added to the rigid insert enabling the fillet radius area to be microfinished. In yet another embodiment, coated abrasive tape includes a multiplicity of perforations thereby permitting the exchange of cutting fluids between the surfaces. Finally, several structures for supporting the rigid inserts for slight rotation relative to the workpiece surface are described.

25 Claims, 14 Drawing Figures

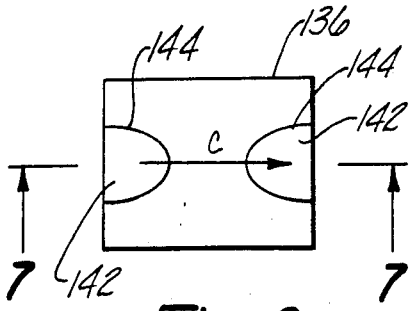
Fig-6
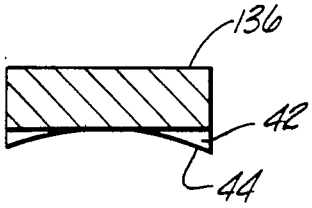
Fig-7
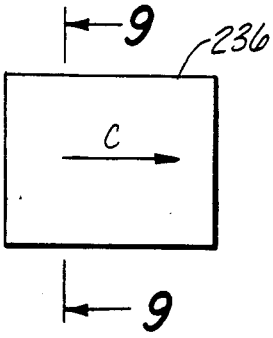
Fig-8
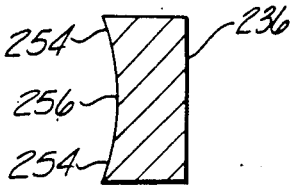
Fig-9
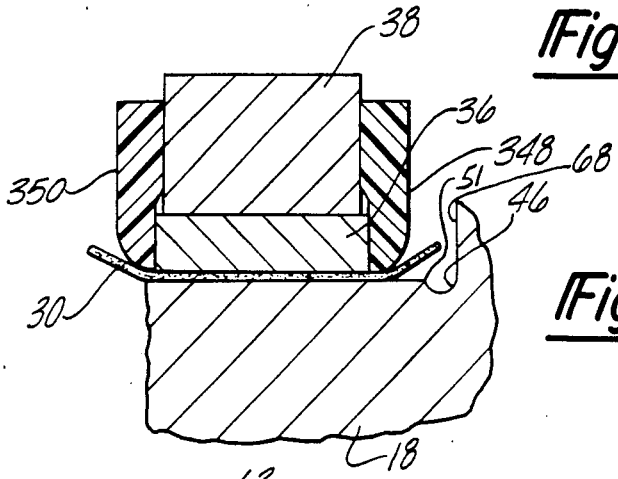
Fig-10
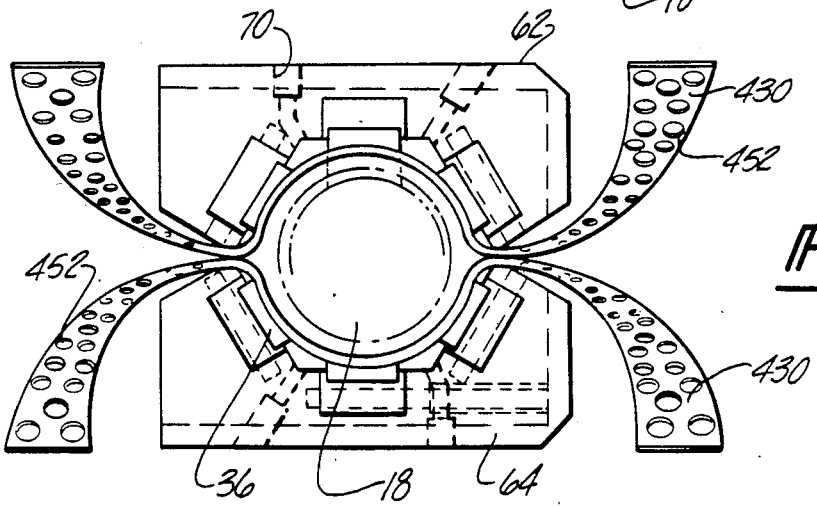
Fig-11
Fig-12
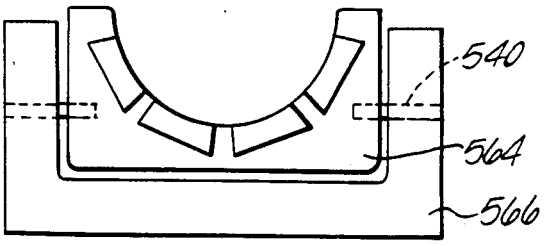

MICROFINISHING APPARATUS AND METHOD

CROSS REFERENCE TO RELATED APPLICATIONS

This application is a continuation-in-part of copending application Ser. No. 608,201, filed May 7, 1984, now abandoned having the same title as the present application.

BACKGROUND AND SUMMARY OF THE INVENIION

This invention relates to metal surface finishing and particularly to an improved apparatus and method for microfinishing metal surfaces using coated abrasive tape materials.

Numerous types of machinery components must have finely controlled surface finishes in order to perform satisfactorily. For example, surface finish control, also referred to as microfinishing, is particularly significant in relation to the manufacturing of journal bearing and cam surfaces such as are found in internal combustion engine crankshafts, camshafts and power transmission shafts and other finished surface. For journal type bearings, very accurately formed surfaces are needed to provide the desired bearing effect which results when lubricant is forced between the journal and the associated bearing. Improperly finished bearing surfaces may lead to premature bearing failure and can limit the load carrying capacity of the bearing.

Currently, there is a demand for higher control of journal bearing surfaces by internal oombustion engine manufacturers as the result of; greater durability requirements necessary to offer improved product warranties, the higher operating speeds at which engines (particularly in automobiles) are now required to sustain, and the greater bearing loads imposed through increased efficiency of engine structures.

In addition to bearing structures, surface finish control must be provided for engine cylinder walls in order to provide the desired oil and gas seal with the piston rings. Numerous other types of machine components also require controlled surface finishes, particularly along areas of sliding contact between parts.

Microfinishing has primarily been accomplished according to the prior art using several different types of machining techniques. In stone microfinishing, a stationary honing stone is brought against the desired surface. When microfinishing cylindrical journal bearing surfaces, the honing stone is caused to oscillate traversely from one edge of the journal to another as the workpiece is rotated with respect to the stone. This possesses a number of significant disadvantages. Due to the requirement that the honing stone be soft enough to be self-dressing and to provide the desired material removal characteristics, the stone, through use, takes on the shape of the part being finished. Therefore, this method, instead of correcting geometry variations in the part being microfinished, actually causes such variations to occur. Additionally, since honing stones are perishable, they must be frequently replaced and redressed. Finally, it is extremely difficult to find honing stones with consistent qualities resulting in significant differences in the finished parts when machined by different stones.

Another significant disadvantage of stone microfinishing of journal bearings using a honing stone is the fact that, since the journals generally include outwardly projecting radius edges, the stone cannot laterally overstroke portions of the surface being machined which leads to uneven stone wearing. Such uneven wearing causes a change in the profile shape of the honing stone, and this shape is consequently generated in subsequent parts being machined. Finally, since the honing stone generally has sharp corner edges, it cannot be used to microfinish near the radius edges of the bearing surface.

In another known microfinishing process, herein referred to as conventional coated abrasive tape microfinishing, the surface being finished is caused to rotate and a coated abrasive tape is brought into contact under pressure with this surface. As the part is rotated, the abrasive material reduces the roughness of the surface. In the conventional process, the tape is brought into contact with the rotating surface by pressure exerted by compressible elastomeric inserts, typically made from urethane plastic compounds. The conventional coated abrasive tape microfinishing process overcomes several of the disadvantages associated with stone microfinishing. This process is capable of microfinishing in the journal fillet radius area since the tape is relatively flexible. In addition, this process uses a renewable abrasive surface which can be purchased having consistent qualities. This process, however, does not overcome other disadvantages of stone microfinishing. Principal among these disadvantages of this process is the fact that the process does not correct geometry variations in the part being microfinished, since the insert backing the coated abrasive tape is a flexible material and therefore, the tape conforms to the surface profile of the component surface being machined.

In still another variation of microfinishing processes known to the prior art, a rigid insert is used to press abrasive coated paper or cloth material into contact with a relatively moving workpiece surface. Abrasive coated paper or cloth materials are, however, relatively thick and oompressible, and therefore, this method did not enable significant workpiece geometry corrections since the paper or cloth would "give" and conform to minute irregularities in the workpiece surface.

In addition to the above-noted shortcomings according to the currently known microfinishing processes, great difficulty has been encountered in removing ferrite caps which are present on the finished surfaces of nodular iron workpieces. These hard caps are present on the outside surface of the bearing and can lead to premature bearing failure.

In view of the above-described shortcomings of microfinishing devices and methods acoording to the prior art, it is a principal object of this invention to provide a microfinishing apparatus and method which is capable of correcting geometry imperfections in finished surfaces. It is yet another object to consistently prcduce surfaces having smoothness characteristics superior to those achievable by conventional means.

The above principal objects of this invention are provided by a microfinishing system which employs an abrasive coated tape which is brought into contact with a rotating workpiece, and is pressed into contact by that wcrkpiece by a rigid precision formed backup insert. This rigid insert does not cause the abrasive tape to conform to the surface profile of the workpiece. Instead, the rigid insert causes greater abrasive tape contact pressure to be applied to portions of the wcrkpiece surface which extend beyond the desired surface, thereby causing greater material removal in those areas. This system therefore permits the microfinishing system to correct geometry imperfections in the workpiece. In the practice of this invention, it is essential that the abrasive coated tape be made of a material which is relatively incompressible such that the tape will not conform to irregularities but instead will enable these irregularities to be removed. Since the insert is not the primary cutting tool, it is not subject to significant changes in profile with use. With appropriate additional components, the rigid inserts may be provided with the capability of polishing fillet radius areas. The microfinishing system according to this invention has been found to provide a significant advance in the art of microfinishing enabling consistent production of surface finishes unachievable using the devices and processes according to the teachings of the prior art.

Additional benefits and advantages of the present invention will become apparent to those skilled in the art to which this invention relates upon a reading of the described preferred embodiments of this invention taken in conjunction with the accompanying drawings.

BRIEF DESCRIPTION OF THE DRAWINGS

FIG. 6 is a second embodiment of this invention employing a rigid back-up insert having relieved portions;

FIG. 7 is a cross-sectional view taken along line 7—7 of FIG. 6;

FIG. 8 shows a third embodiment of this invention using a modified rigid back-up insert;

FIG. 9 is a cross-sectional view taken along line 9—9 of FIG. 8;

FIG. 10 illustrates a fourth embodiment of this invention wherein a rigid back-up insert is used with flexible inserts such that the fillet radius portions may be microfinished;

FIG. 11 shows a fifth embodiment of this invention wherein solid back-up inserts are used in conjunction with a perforated coated abrasive tape which enhances lubricant flow to the surface being microfinished;

FIG. 12 shows a sixth embodiment of this invention wherein an alternate means of mounting the polishing shoe assembly is shown;

DETAILED DESCRIPTION OF THE DRAWINGS

Figure 1:
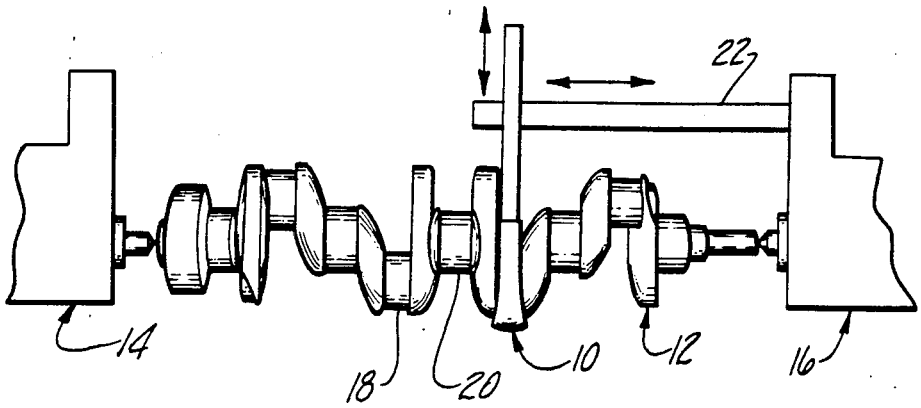
FIG. 1 is a pictorial view of a crankshaft being rotated such that one of its is being microfinished by the clamping of a polishing shoe the pin journal.

A polishing shoe assembly is shown by FIG. 1 and is designated there by reference character 10. Polishing shoe assembly 10 is shown with the associated support mechanisms shown schematically and is shown in position to microfinish a bearing surface of an internal combustion engine crankshaft. As is shown by that Figure, crankshaft 12 is supported at opposing ends by headstock 14 and tailstock 16 which together cause the crankshaft to be rotated about its longitudinal center axis. Crankshaft 12 includes a plurality of cylindrical bearing surfaces which must be microfinished including pin bearings 18 which, in use, becomes connected to a piston connecting rod; and main bearings 20, which support the crankshaft for rotation within the engine block. Polishing shoe assembly 10 is shown mounted to arm 22. Polishing shoe assembly 10 is caused to oscillate laterally along the surface being machined by oscillating the shoe assembly, or by oscillating the workpiece relative to the shoe assembly. Arm 22 permits polishing shoe assembly 10 to orbit with pin bearing 18 since that bearing journal is positioned eccentrically with respect to the center of rotation of crankshaft main bearings 20.

Figure 2:
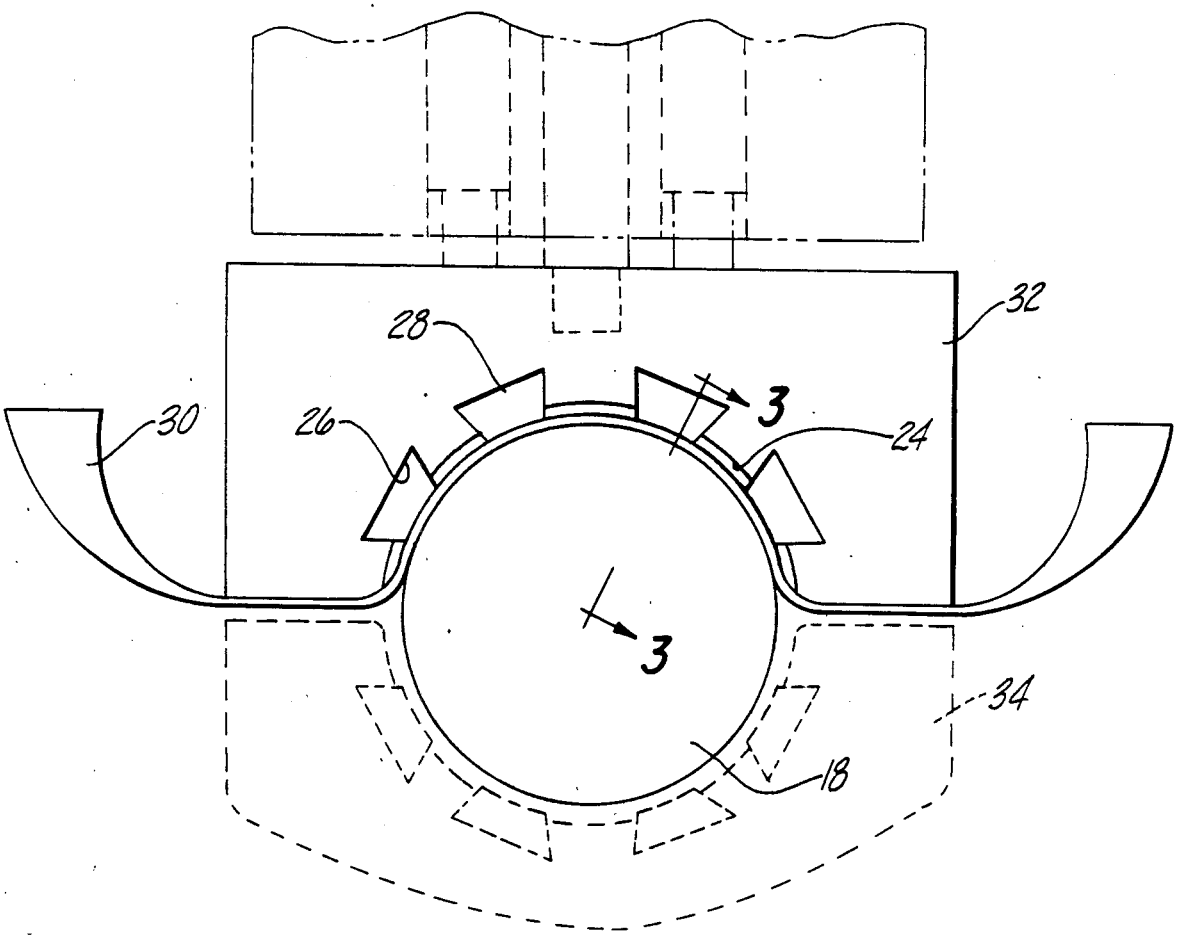
FIG. 2 is a cross-sectional view taken through a polishing shoe assembly according to the prior art.

With particular reference to FIG. 2, a polishing shoe assembly according to the prior art is illustrated. Polishing shoe assembly 10 includes two halves, upper shoe 32 and lower shoe 34 (shown partially in phantom lines). These halves are each connected to a support structures which may include hydraulic or pneumatic biasing cylinders acting on the shoe halves (as shown in phantom lines in FIG. 2) or may be supported by a scissors type linkage device. This polishing shoe assembly employs a semicircular surface 24 having a plurality of spaced dovetail-shaped grooves 26. Within dovetail grooves 26 are installed cooperatively shaped urethane inserts 28. These inserts, due to the material from which they are made, are comparatively flexible and compressible, having a Durometer hardness of 90 or less. Each of the shoe portions include means for engaging coated abrasive tape 30 which is brought into compressive contact with the surface of pin bearing 18. At the conclusion of the microfinishing operation of one pin bearing 18, upper and lower shoes 32 and 34 are caused to separate and are repositioned and clamped onto another pin bearing 18 or a main bearing 20. Alternatively, a plurality of polishing shoe assemblies may be provided such that the entire workpiece may be machined in one operation. Simultaneous with shoe disengagement and reengagement is an indexing of tape 30 such that a predetermined length of new abrasive material is brought into shoe assembly 10. This indexing results in the abrasive surface being constantly renewed.

Figure 3:
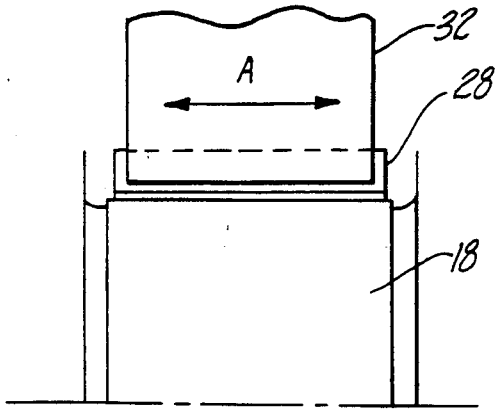
FIG. 3 is a cross-sectional view taken along line 3—3 of FIG. 2.

FIG. 3 illustrates a cross-sectional view taken through FIG. 2 and shows contact between insert 28 and pin bearing 18. Insert 28 is caused to traverse relating to the surface of pin bearing 18 as indicated by arrow A. Insert 28, being made of a flexible material, is caused to conform to the existing surface profile of pin bearing 18. Therefore, if imperfections such as waviness, taper, convexness or concavity of the bearing surface exist, coated abrasive tape 30 will be caused to conform to the incorrect shape. As a result, this prior art microfinishing method does not correct geometry imperfections in the parts being microfinished.

Figure 4:
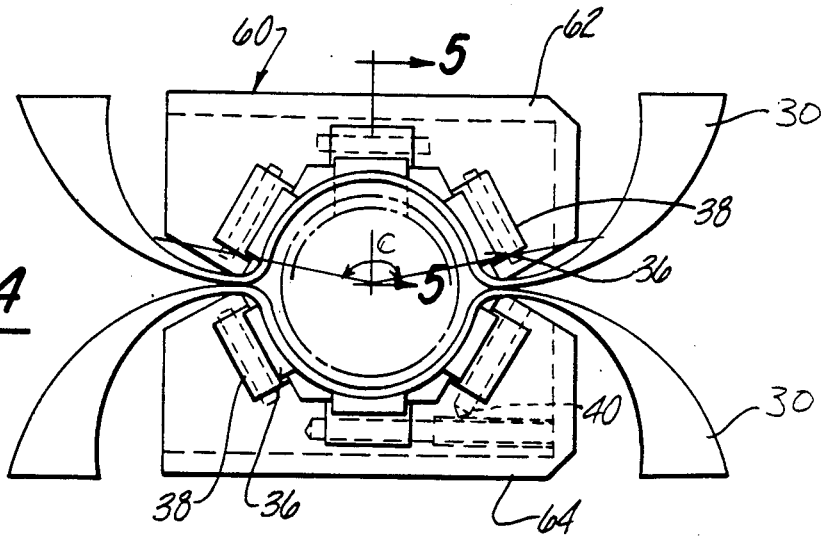
FIG. 4 is a cross-sectional view of a polishing shoe assembly according to the subject invention.

FIG. 4 shows polishing shoe assembly 60 according to a first embodiment of this invention. Polishing shoe assembly 60 includes upper shoe 62 and lower shoe 64. Polishing shoe assembly 60 varies principally from shoe assembly 10 shown by FIGS. 2 and 3 in that urethane inserts 28 are replaced with stone inserts 36. These inserts are preferably made from honing stone material. Stones inserts 36 are characterized in that they are relatively non-deformable having a Durometer hardness greater than 90, yet are easily machined and provide a degree of frictional engagement with coated abrasive tape 30. Each of stone inserts 36 are mounted to a holder 38. Stone inserts 36 and holders 38 are preferably permitted to "float" slightly with respect to the upper and lower shoes, enabling them to rotate slightly as indicated by arrow B in FIG. 5. Such relative rotation is provided according to this embodiment by mounting holders 38 using mounting pins 40. Like shoe assembly 10, coated abrasive tape 30 is supported by shoes 62 and 64 such that when they engage pin bearing surface 18, the tape is brought into contact with the surface being microfinished.

Figure 5:
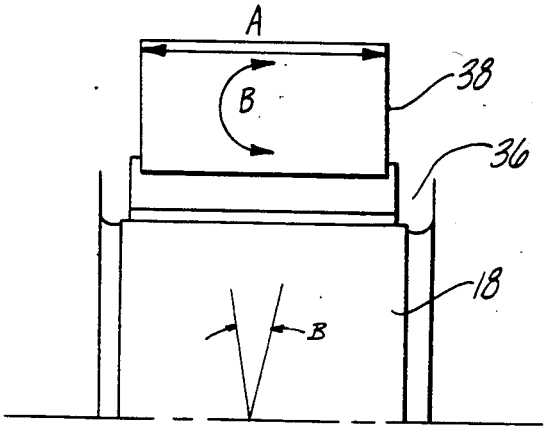
FIG. 5 is a cross-sectional view taken along line 5—5 of FIG. 4.

The principal advantages of the configuration of polishing shoe assembly 60 are best explained with reference to FIG. 5. Stone insert 36 is provided which presents a surface having a predetermined curvature which is rigid and which exerts a compressive load on tape 30 against pin bearing 18. Since stone inserts 36 are rigid and relatively non-conformable, surface waviness, taper, convexity and concavity of the surface of pin tearing 18 are corrected since, in these instances, non-conforming portions of the surface of pin bearing 18 will be brought under greater contact pressures against coated abrasive tape 30, and therefore, more material will be removed in those areas until pin bearing 18 assumes the desired surface profile. Coated abrasive tape 30 is preferably made of a polymeric plastic film material which is relatively incompressible. Polyester films made from polyethylene terephthalate such as MYLAR (a trademark of EI du Pont de Nemours Co.) have been found satisfactory due to their relatively low compressibility. The thickness of tape 30 is preferably in a range of between 2 and 8 mills. The combined rigidity or lack of compressibility of insert 36 and tape 30 insures that imperfections in the workpiece will be removed. Abrasive coated paper or cloth products are generally unsuitable for use in connection with this invention since they are relatively compressible as compared to polymeric plastic tape materials of the type described above. Additionally, the grit size of abrasive coated papers is generally not as uniform as that of abrasive coated polymeric plastic tape materials. As with the prior art devices, insert 36 and shoe assembly 60 is caused to oscillate relative to pin bearing 18 as the bearing is rotated relative to the shoe assembly, as indicated by arrow A in FIG. 5. Such lateral movement is achieved by moving the workpiece relative to polishing shoe assembly 62, or by moving the polishing shoe assembly relative to the workpiece, or a combination of both. When relative lateral movement is initiated, frictional engagement between stone insert 36 and coated abrasive tape 30 is necessary in order to urge the tape to move laterally. For this reason, hard materials having a very smooth surface such as machined metals are generally unsuitable for insert 36, unless they are sufficiently roughened to frictionally engage the back of coated tape 30. Materials which have been found suitable for insert 36 are conventional honing stone materials. These materials exhibit the desired hardness and frictional characteristics and have been found to produce excellent results.

Now with particular reference to FIG. 4, another feature in accordance with this invention will be described. Angle C, shown in FIG. 4, designates the maximum range of the point of contacts of the shoes 36 within either of the shoes 62 or 64. The inventors have found that Angle C should be at least 120° and preferably about 160° to provide improvements in terms of part geometry correction and rate of material removal as compared with shoes having a lesser range of angular contact. Improvements in part geometry correction are believed attributable to the fact that, with a larger angle of contact (Angle C), the shoes more closely approximate a cylinder themselves and therefore force the workpiece to assume such a configuration. The increase in material removal rate is believed attributable to a wedging effect wherein the contact pressures existing at the outer ranges of contact of the shoe are greater.

During the course of development of this invention, the inventors further discovered that the rate of lateral oscillation of upper and lower shoes 62 and 64 was important in terms of producing the desired machining action. The shoes 62 and 64 are oscillated laterally while the workpiece is rotated (or the workpiece may be moved laterally while the shoes are stationary). Abrasive coated tape 30 causes a cross hatched pattern to be developed on the workpiece surface. These cross hatch patterns can be defined by lines which coincide with the direction of relative motion between the workpiece and abrasive coated tape 30 as best shown in FIG. 5. Cross latch angle is a function of the rates of workpiece rotation and shoe oscillation and workpiece surface diameter. The inventors have found that the cross hatch angle defined by Angle D, must exceed 2° in the area of the longitudinal center of the bearing in order to provide acceptable finish quality and bearing performance. This cross hatch angle (Angle D) is somewhat greater than that according to prior art machines and methods and contributes toward improving the quality of bearing surfaces generated.

Modern day crankshafts are often made from nodular iron which has imbedded ferrite nodules. These nodules present themselves as caps on the bearing surface which should be removed in order to provide the desired bearing characteristics. During the course of development of this invention, it was discovered that removal of these ferrite caps was possible by first rotating the workpiece in one direction and then rotating the workpiece in the opposite direction. This process is believed effective since the minute abrasive grains on tape 30 become smoothened on one side, yet remain sharp on the other side, and reversing rotation permits the sharp grain sides to also remove material.

Other types of coated abrasive tape material 30 could be employed in connection with this invention. For example, a metal backed tape which is coated with abrasive material could also be used. However, it is essential that tape material 30 be relatively incompressible.

FIGS. 6 and 7 illustrate a second embodiment according to this invention. For this embodiment, portions of insert 136 are partially relieved such that they do not cause high contact pressure between coated abrasive tape 30 and pin bearing 18. FIG. 6 shows a pair of cpposed relief portions 142 which are defined by arcuate borders 144. The surface of pin bearing 18 moves with respect to insert 136 in the direction indicated by arrow C. This second embodiment causes greater abrasive material removal to occur at the separated ends of the surface of pin bearing 18. This second embodiment therefore tends to cause the pin bearing surface to assume a slightly barrel shaped configuration, such that its diameters at each end are slightly less than the diameter at the center. Such "barrelling" is sometimes desirable to achieve optimal bearing surfaces.

A third embodiment according to this invention is shown with reference to FIGS. 8 and 9. This embodiment also produce a slightly barrel shaped journal bearing surface but achieves this result in a different manner than that according to FIGS. 6 and 7. A modified cylindrical contour in insert 236 is produced so that the radius of the curved insert surface at points near the ends of the journal bearing is less than at the center of the journal bearing. As shown by FIG. 8, relative movement of pin bearing 18 with respect to insert 236 occurs along the direction indicated by arnow C. As illustrated by FIG. 9, portions of the surface of insert 236 near the lateral edges are designated by reference character 254 and have a radius of curvature somewhat less than that of central shoe segment 256 (these differences in radius are exaggerated in FIG. 9 for illustration purposes). This embodiment, therefore, provides another means for generating a non-cylindrical surface and a workpiece being machined. According to this embodiment, such shaping results from machining the desired surface contour directly into stone insert 236 and this contour will be impressed and machined in the corresponding wcrkpiece.

A fourth embodiment of this invention is illustrated by FIG. 10, which enables the side wall portion 68 of pin bearing 18 to be finished and further permits any burrs existing between filet radius 46 and the bearing surface to be removed. In accordance with this embodiment, flexible inserts 348 and 350 are provided with inserts 36. These flexible inserts exert a compressive force against coated abrasive tape 30 when the inserts are brought to their extreme lateral positions. Although the employment of a flexible material for inserts 348 and 350 results in the same shortcomings associated with conventional processes, it is generally not necessary to highly control the profile shape of these surfaces. Since it is necessary for tape 30 to flex to a considerable extent when brought into contact with side wall portion 68, it is sometimes necessary to provide edge cuts within the coated tape, according to principles known to the prior art. Use of inserts 348 and 350 further permits the elimination of burrs or sharp edges which may exist at the edges 51 of the bearing surface of journal 18 when the fillet radius are cut deep into the workpiece (as shown by FIG. 10). By mounting inserts 348 and 350 such that they exert a slight compressive load on the surface of bearing 18, tape 30 is caused to remove such burrs when the insert forces the tape into the fillet.

FIG. 11 illustrates a fifth embodiment according to this invention. This embodiment employs inserts 36 and upper and lower shoes 62 and 64 as described in connection with FIG. 4. This embodiment differs from the previously described embodiments in that coated abrasive tape 430 is used which has a multiplicity of perforations 452 along its length. Perforations 452 enable lubricants or cutting fluids to come in contact with the surfaces being machined. Flow of lubricant or cutting fluids to the workpiece is conducted through passage 70 within upper and lower shoes 62 and 64.

A sixth embodiment according to this invention is described with reference to FIG. 12. As shown by that Figure, lower shoe 564 is mounted within cradle 566 by a mounting pin 540. These mounting pins permit rotation of lower shoe assembly 564 with respect to cradle 566. A similar mounting arrangement would also be provided for upper shoe assembly 562 (not shown). This arrangement provides the desirable "floating" characteristic as described with reference to FIG. 4 wherein individual mounting pins 40 are provided for each of the inserts 36. The construction illustrated by FIG. 12 has the primary advantage of being simpler to construct. In operation, this embodiment performs as described in connection with the earlier described embodiments.

Figure 13:
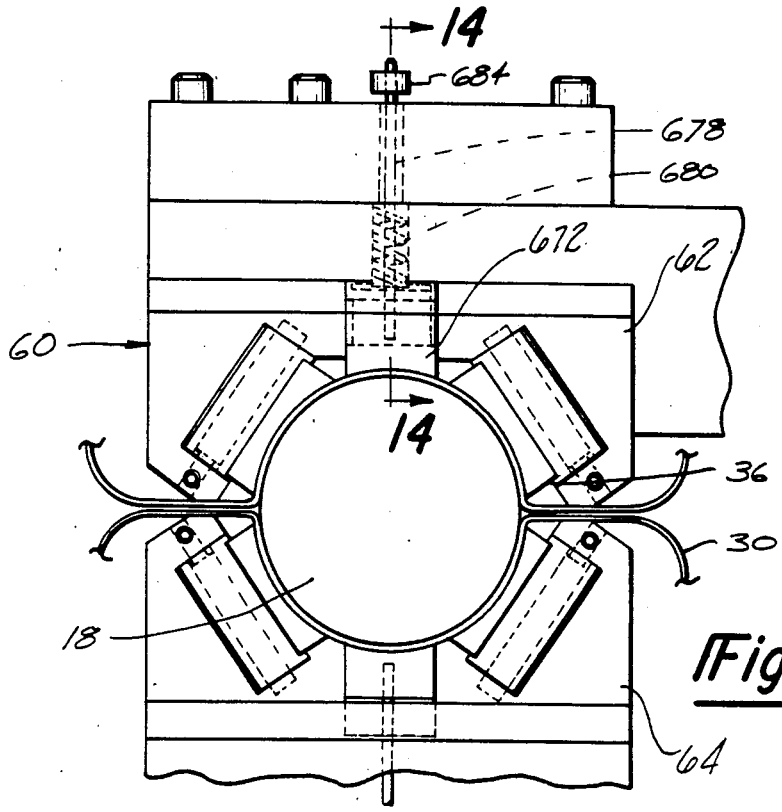
FIG. 13 shows a seventh embodiment of this invention wherein an elastomeric insert is provided to polish the filet radius and side wall portions of a workpiece.
Figure 14:
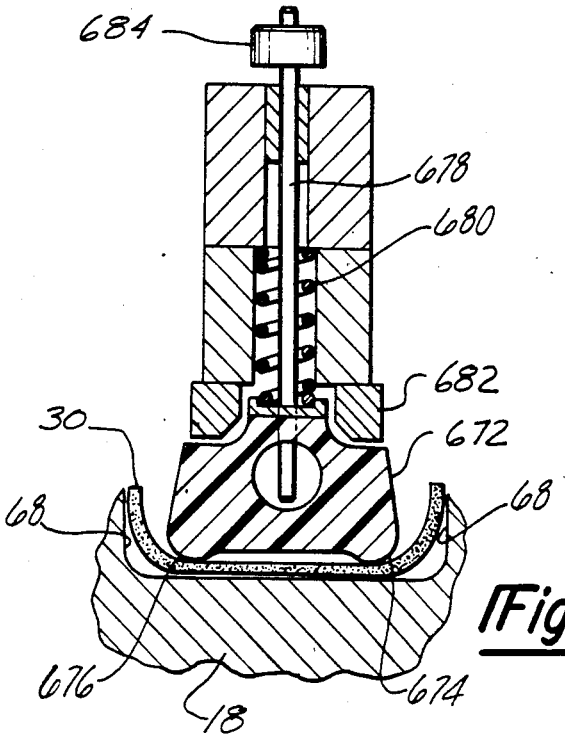
FIG. 14 is a cross-sectional view taken along line 14-14 of FIG. 13 particularly showing the elastomeric insert according to this embodiment of the invention.

A seventh embodiment according to this invention is shown by FIGS. 13 and 14. This embodiment provides another means of finishing the side wall portions 68 of a bearing 18 or 20. In accordance with this embodiment, upper shoe 62 and/or lower shoe 64 include elastomeric insert 672 which is employed to polish the side wall portions 68. As shown by FIG. 13, upper shoe 62 and lower shoe 64 are constructed identical to that described with reference to FIG. 4 except that one or more of stone inserts 36 is replaoed by elastomeric insert 672. Elastomeric insert 672 is particularly shown in detail by FIG. 14. As shown by that Figure, insert 672 is made from an elastomeric substance such as a urethane compound and includes radiused edge surfaces 674 and 676. Insert 672 has a lateral width which exceeds that of stone inserts 36 such that as polishing shoe assembly 60 is stroked laterally, radiused side surfaces 674 and 676 cause coated abrasive tape 30 to contact side wall portions 68, thereby microfinishing that area. Preferably, elastomeric insert 672 is resiliently biased within the associated shoe portion, enabling it to move radially and laterally with respect to the associated bearing surface. As shown by FIG. 14, lateral compliance of elastomeric insert 672 is provided by employing drill rod 678 which flexes, enabling the insert to move laterally with respect to upper shoe 62. The maximum extent of lateral compliance is limited by contact between elastomeric insert 672 and insert holder 682. Radial compliance for insert 672 is provided by employing helical coil spring 680 which exerts a downward compressive force upon coated abrasive tape 30. The maximum extent of radial displacement is controlled by the position of head 684 on drill rod 678. This embodiment provides another means of gaining the advantages of a rigid insert in accordance with this invention and further finishing the side wall and radius portions of the bearing surface being microfinished.

While the above description constitutes the preferred embodiments of the present invention, it will be appreciated that the invention is susceptible to modification, variation and change without departing from the proper scope and fair meaning of the accompanying claims.

What is claimed is:

1. A machine for microfinishing an outside curved surface of a workpiece, comprising:

abrasive coated tape, a shoe assembly having means for holding said tape and having a rigid surface forming a predetermined surface shape related to a desired workpiece surface shape, said rigid surface contacting and pressing said tape into contact with said workpiece surface, said rigid surface defining an included angle between the boundaries of contact between said tape and said shoe of greater than 135° and less than 180° relative to the center of said curved workpiece surface, means for causing relative rotation between said workpiece and said shoe assembly, and an arm which supports said shoe assembly such that relative movement between said workpiece surface and said tape occurs as said workpiece is rotated relative to said shoe assembly.

2. The machine for microfinishing a surface of a workpiece according to claim 1 wherein said abrasive coated tape is made from a polyester plastic.

3. The machine for microfinishing a surface of a workpiece according to claim 1 wherein said abrasive coated tape is made from polyethylene terephthalate.

4. The machine for microfinishing a surface of a workpiece according to claim 1 wherein said rigid surface is composed of a metal having a roughened surface.

5. The machine for microfinishing a surface of a workpiece according to claim 1, wherein said rigid surface is formed by at least one insert mounted to said shoe assembly.

6. The machine according to claim 5 wherein said insert surface extends over greater circumferential distances at its lateral ends such that more material is removed from selected areas of said workpiece surface.

7. The machine according to claim 5 wherein said insert surface is shaped having segments of varying radii, thereby forming a desired profile shape in said workpiece.

8. The machine according to claim 5 wherein said workpiece surfaces terminate laterally with radially outwardly projecting surfaces thereby forming a fillet radius therebetween, said insert further including at least one elastomeric insert mounted adjacent said insert which presses said tape into contact with said fillet radius.

9. The machine according to claim 5 further comprising, at least one second insert made from an elastomeric material having a lateral width greater than said insert, said second insert applying a compressive force against radially outwardly projecting surfaces of said workpiece and thereby finishing said surface.

10. The machine according to claim 9 further comprising, resilient mounting means for said second insert which becomes deflected as said shoe assembly is moved to its extreme lateral positions.

11. The machine for microfinishing a surface of a workpiece according to claim 1, wherein said rigid shoe surface is formed by at least one insert mounted to said shoe assembly by a mounting pin which permits slight relative rotation of said insert with respect to said shoe assembly about an axis generally perpendicular to the axis of rotation of said workpiece.

12. The machine for microfinishing a surface of a workpiece according to claim 1, wherein said rigid surface is formed by at least one insert mounted to said shoe assembly and said shoe assembly is mounted to said arm by a mounting pin such that slight relative rotation of said shoe assembly with respect to said arm is permitted about an axis generally perpendicular to the axis of rotation of said workpiece.

13. The machine for microfinishing a surface of a workpiece according to claim 1, wherein said rigid surface is formed by an insert composed of honing stone material.

14. The machine for microfinishing a surface of a workpiece according to claim 1, wherein said rigid surface has a hardness exceeding the equivalent of 90 durometer.

15. The machine according to claim 1 wherein said shoe assembly includes upper and lower shoe portions, each of said portions having at least one insert defining said rigid surface.

16. The machine according to claim 15 wherein all portions of said insert surface extend over the same circumferential distance.

17. The machine according to claim 1 wherein said included angle is approximately 160°.

18. A method of microfinishing a workpiece an outside curved workpiece surface which comprises the steps of:

rotating said workpiece, and causing a rigid shoe surface to contact and press an abrasive coated tape against said workpiece surface, said rigid shoe surface having a predetermined shape related to the desired workpiece surface shape and defining an included angle between the boundaries of contact between said tape and said shoe of greater than 135° and less than 180° relative to the center of said curved workpiece surface, whereby a desired workpiece surface shape is generated in said workpiece surface.

19. The method according to claim 18 wherein said rigid surface has a hardness exceeding the equivalent of 90 durometer.

20. The method according to claim 18 wherein said abrasive coated tape is made from a polyester plastic.

21. The method according to claim 18 wherein said abrasive coated tape is made from polyethylene terephthalate.

22. The method according to claim 18 further comprising the step of causing an elastomeric insert to press said abrasive coated tape against said workpiece surface and against the radially outwardly projecting surfaces of said workpiece.

23. The method according to claim 18 further comprising the step of moving said rigid shoe surface laterally as said workpiece is rotated.

24. The method according to claim 18 further comprising rotating said workpiece in one direction and then rotating said workpiece in an opposite direction.

25. The method according to claim 11 wherein said included angle is approximately 160°.

* * * * *